United States Patent [19]

Hoffmann et al.

[11] 4,187,171

[45] Feb. 5, 1980

[54] SIFTING MACHINE

[75] Inventors: Reinhard Hoffmann; Jürgen Hoffmann; Norbert Hoffmann, all of Plockhorst, Fed. Rep. of Germany

[73] Assignee: Fried. Krupp Gesellschaft mit beschränkter Haftung, Essen, Fed. Rep. of Germany

[21] Appl. No.: 607,959

[22] Filed: Aug. 26, 1975

[30] Foreign Application Priority Data

Aug. 31, 1974 [DE] Fed. Rep. of Germany ..... 2441859

[51] Int. Cl.[2] ..... B07B 1/34; B07B 1/54

[52] U.S. Cl. ..... 209/383; 209/308; 209/357

[58] Field of Search ..... 209/347-349, 209/363, 364, 323, 325, 276, 330, 308, 380, 381-383, 365 R; 210/400, 389, 384; 74/97, 100 R, 99 R; 55/296, 300

[56] References Cited

U.S. PATENT DOCUMENTS

| | | | |
|---|---|---|---|
| 334,246 | 1/1886 | Leake | 209/383 |
| 1,069,453 | 8/1913 | McDaniel | 209/383 |
| 1,726,630 | 9/1929 | Seltner | 209/347 X |
| 1,864,940 | 6/1932 | Reynolds | 209/347 X |
| 3,796,311 | 3/1974 | Krause | 209/347 X |
| 3,896,030 | 7/1975 | Bahr | 210/384 |

FOREIGN PATENT DOCUMENTS

| | | | |
|---|---|---|---|
| 723768 | 8/1942 | Fed. Rep. of Germany | 55/300 |
| 582292 | 11/1946 | United Kingdom | 55/300 |

*Primary Examiner*—Ralph J. Hill
*Attorney, Agent, or Firm*—Spencer & Kaye

[57] ABSTRACT

A sifting machine includes a screen; a plurality of spaced leaf springs supported below the screen and extending transversely to the length dimension of the screen; and a drive connected to the leaf springs for causing each leaf spring to periodically bend away from the screen and subsequently move rapidly towards the screen to intermittently beat the latter. The active beating length of each leaf spring is somewhat less than the useful width of the screen. There are further provided a downwardly resiliently yielding support for opposite ends of the active beating length of each leaf spring and a cable or the like attached to the mid portion of each leaf spring. The cable forms part of the drive for agitating each leaf spring.

6 Claims, 5 Drawing Figures

FIG. 1
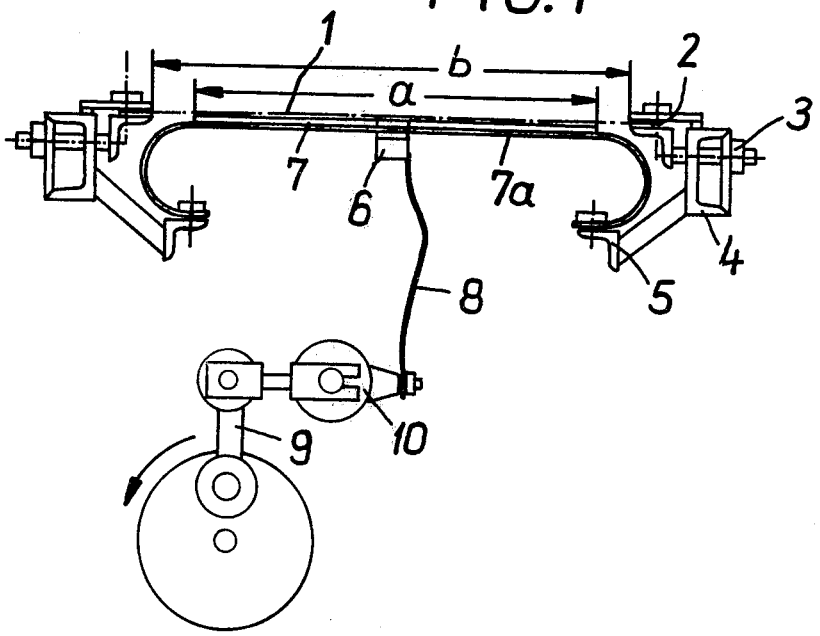
FIG. 2
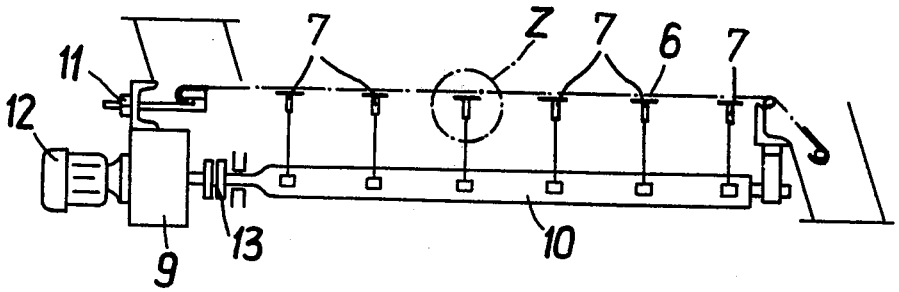
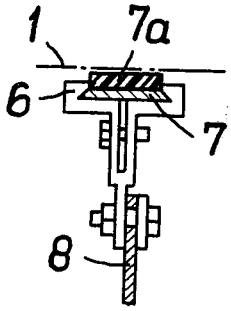
FIG. 2a

SIFTING MACHINE

BACKGROUND OF THE INVENTION

This invention relates to a sifting machine having a screen and a plurality of spaced leaf springs, each extending immediately below the screen and transversely thereto for acting upon the screen vertically from below. The leaf springs, as components of a vibrator system, engage directly, although loosely, the screen and are agitated by a drive reciprocating in a direction perpendicular to the plane of the screen.

A sifting machine of the above-outlined type is disclosed, for example, in German Pat. No. 1,189,363 where there is described a flat-screen sifting machine for limestone grinding installations or the like. The leaf springs are longitudinally axially displaceably supported at two oppositely located legs of the screen frame. An end of each leaf spring extends beyond the associated frame leg and is disposed, against the action of a return spring, in the travelling path of a rotating lifting cam. As the cam rotates, the extended ends of the leaf springs are continuously oscillated back and forth against the force of the return spring in a direction perpendicular to the plane of the screen. In this manner the leaf springs beat the screen in their entirety and thus alternatingly bulge the screen and move away therefrom. In this manner there is achieved a continuous, alternating flexing of the screen surface proper. If there are differences in the natural frequencies of the leaf springs and the rpm of the rotary cam, there appear irregularities in the screen motion which lead to whip-like impacts imparted on the screen. This prevents an accumulation of the material in certain zones of the screen surface and simultaneously enhances the passage of the material.

The above-outlined principle of operation has been proven to be very advantageous in sifting machines. It has been found, however, that in the course of an extended operation there occurs damage to the screen fabric caused by the leaf springs, particularly along the clamped longitudinal edges. It has been a further disadvantage that because of the cam drive, the operation of the sifting machine is very noisy. Also, in case of an overload, the resulting downward bulge of the screen fabric was likely to cause a downward bending of the leaf springs so that the ends of the leaf springs to be engaged by the cam have lifted to such an extent that they were no longer disposed in the travelling path of the rotating cams.

SUMMARY OF THE INVENTION

It is an object of the invention to provide an improved sifting machine of the afore-outlined type from which the discussed disadvantages are eliminated.

This object and others to become apparent as the specification progresses, are accomplished by the invention, according to which, briefly stated, the beating length of the leaf springs is somewhat smaller than the effective width of the sieve fabric; the ends of the leaf springs are supported on downwardly elastically yielding components and further, the drive engages each leaf spring at its mid portion by means of a cable or the like.

It has been found that by virtue of the above-outlined design of the leaf springs a damage to the sieve fabric can be securely avoided. The drive designed according to the invention is significantly less noisy than conventional structures and further, since it always engages the leaf springs at their mid portion, it is operationally safe with great reliability even in case of an overload of the screen.

During downward movement of the drive each leaf spring is tensioned by an associated, otherwise slack cable attached to the leaf spring and the drive. During upward motion of the drive the leaf springs freely snap upwardly and hit the screen from below by virtue of their own resilient force. The leaf springs have, in addition to the frequency imposed by the drive, their own natural frequency so that the engagement of the screen is effected with continuously changing frequency and amplitude. This effect is further supported by the changing specific load of the screen.

By virtue of the whip-like impacts of the leaf springs and the high acceleration and large amplitudes in case of a stationary sieve frame, there are achieved high specific extended outputs with the separation of the finest, sift-resistant material down to 32 microns. While most of the conventional sifting machines can be operated below a certain mesh size only with significant energy input when square meshes are used, according to the invention all types of screen fabrics with square mesh can be operated without difficulty.

According to an advantageous embodiment of the invention, the ends of each leaf spring are bent approximately in a semicircle downwardly and form a downwardly yielding support for the leaf spring. Further, it is advantageous to provide the leaf springs with a neoprene coating on their face oriented towards the screen. This feature protects even the finest screen fabric from damage by the leaf springs.

The drive may expediently comprise a drive shaft positioned under the screen and oriented longitudinally thereto. To the circumference of the drive shaft there are attached, directly or indirectly, the lower ends of all the cables or the like. To the shaft there are imparted torsional oscillations of preferably 50 Hz by means of a crank drive.

A doubling of the screen width may be achieved in a simple manner by arranging two juxtapositioned rows of leaf springs which are agitated by a central drive.

It is further feasible to use the sifting machine as a dewatering sieve. In such a case, a circulating endless screen fabric is provided, above the lower reach of which there is arranged a cleaning device which may operate with air, liquid or mechanical elements.

BRIEF DESCRIPTION OF THE DRAWINGS

FIG. 1 is a schematic front elevational view of a preferred embodiment of the invention.

FIG. 2 is a schematic sectional side elevational view, on a reduced scale, of the embodiment shown in FIG. 1.

FIG. 2*a* is a sectional side elevational view, on an enlarged scale, of the inset Z shown in FIG. 2.

DESCRIPTION OF THE PREFERRED EMBODIMENTS

Figure 3:
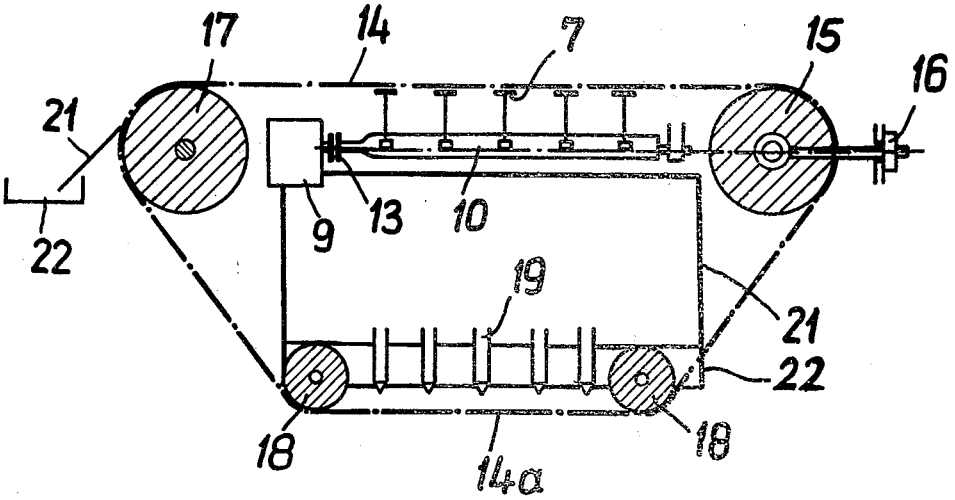
FIG. 3 is a schematic sectional side elevational view of a dewatering screen incorporating the preferred embodiment of the invention.

Turning now to FIGS. 1, 2 and 2*a*, the sifting machine shown therein has a sieve screen 1 which is held by means of clamping strips 2 and tensioning screws 3 on longitudinal edges of a screen frame 4. Each longitudinal edge of the screen frame 4 carries a series of supports 5. Transversely aligned supports form a support pair. To the supports 5 of each support pair there are secured the semicircularly downwardly bent ends of a separate leaf spring 7. The two semicircular ends of each leaf spring serve as downwardly yielding supports for the effective length a (active beating length) of the leaf spring. Each leaf spring 7 is provided, substantially along its length portion a, with a neoprene coating *7a* on its surface oriented towards the screen 1. The active length a of each leaf spring 7 is somewhat smaller than the effective width b of the screen 1.

Thus, it was found advantageous to provide a beating length of 68 cm for each leaf spring in case of an effective screen width of 75 cm. To each leaf spring 7 there is secured, approximately to the mid portion thereof, a cable 8 by means of a clamp 6. The lower end of each cable 8 is secured to the lugs of a drive shaft 10 which is arranged below the screen 1 and is oriented in the longitudinal direction thereof. The drive shaft 10 is agitated by means of a crank drive 9 to execute torsional oscillations.

In FIG. 2 there is shown a longitudinal tensioning means 11 for the screen 1 as well as an electromotor 12 which is connected to the drive shaft 10 by means of a clutch 13. As seen in FIG. *2a* which illustrates in detail the inset Z of FIG. 2, the cable clamp 6 has a dovetail-shaped groove for receiving the leaf spring 7, the neoprene coating *7a* of which projects above the cable clamp 6.

Figure 4:
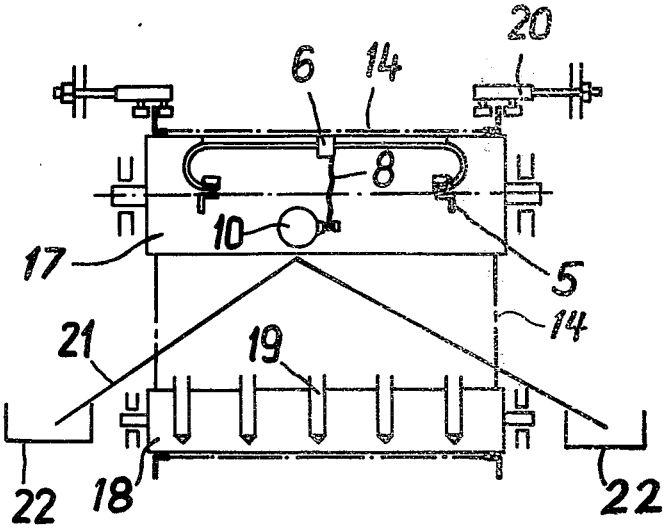
FIG. 4 is a schematic cross-sectional view of the apparatus shown in FIG. 3.

Turning now to FIGS. 3 and 4 there is shown a dewatering screen which has an endless screen fabric 14 trained about a tensioning drum 15 controlled by a tensioning screw 16, a tensioning drum 17 and two support rollers 18. The structure and drive of the leaf springs 7 are identical to those illustrated in FIGS. 1, 2 and *2a*. Above the lower reach 14*a* of the endless screen 14 there is arranged a cleaning device 19.

In FIG. 4 there is shown a modified transversal tensioning means 20 for the circulating endless screen 14. Below the screen there are provided guide plates 21 and collecting troughs 22 for the sifted material.

It will be understood that the above description of the present invention is susceptible to various modifications, changes and adaptations, and the same are intended to be comprehended within the meaning and range of equivalents of the appended claims.

What is claimed is:

1. In a sifting machine including a screen having a length dimension; a plurality of spaced leaf springs supported below the screen and extending transversely to the length dimension of the screen; drive means connected to the leaf springs for causing each leaf spring to periodically bend away from the screen and subsequently move rapidly towards the screen to intermittently beat the latter, the improvement wherein the active beating length of each leaf spring is somewhat less than the effective width of said screen; further comprising downwardly resiliently yielding support means for opposite ends of said active beating length of each said leaf spring; said drive means including flexible cables, one associated with each said leaf spring, each cable having a first end attached to the mid portion of the associated leaf spring; and a pulling device attached to a second end of the associated cable for periodically pulling said leaf springs away from said screen for tensioning and then abruptly releasing them for causing them to move, driven solely by their own resiliency, towards and beat against said screen.

2. A sifting machine as defined in claim 1, wherein each leaf spring has at least approximately semicircularly downwardly bent opposite ends constituting said downwardly resiliently yielding support means; further comprising means to which the leaf spring ends are attached.

3. A sifting machine as defined in claim 1, each leaf spring having a face oriented towards said screen; further comprising a neoprene coating provided on said face.

4. A sifting machine as defined in claim 1, including a separate cable clamp attaching said first end of each cable to the associated leaf spring.

5. A sifting machine as defined in claim 1, wherein said pulling device comprises a drive shaft supported below said sieve screen and extending in the length dimension thereof; means for at least indirectly securing to said shaft said second end of each cable; motor means; and crank means coupled to said motor means and said drive shaft for imparting torsional oscillations to said drive shaft by said motor means through said crank means.

6. A sifting machine as defined in claim 1, wherein said screen is an endless circulating screen including a lower reach; further comprising a screen cleaning device situated above said lower reach.

* * * * *